US009896976B2

(12) United States Patent
Shewell

(10) Patent No.: US 9,896,976 B2
(45) Date of Patent: Feb. 20, 2018

(54) VARIABLE CAMSHAFT PHASER WITH A LINEAR ACTUATOR FOR ABSOLUTE POSITIONING

(71) Applicant: Schaeffler Technologies AG & Co. KG, Herzogenaurach (DE)

(72) Inventor: Jeffrey Shewell, Rochester, MI (US)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 81 days.

(21) Appl. No.: 15/167,436

(22) Filed: May 27, 2016

(65) Prior Publication Data

US 2016/0319710 A1 Nov. 3, 2016

(51) Int. Cl.
*F01L 1/46* (2006.01)
*F01L 1/344* (2006.01)

(52) U.S. Cl.
CPC ..... *F01L 1/344* (2013.01); *F01L 1/3442* (2013.01); *F01L 1/34409* (2013.01); *F01L 1/46* (2013.01); *F01L 2001/34483* (2013.01)

(58) Field of Classification Search
CPC ..... F01L 1/344; F01L 1/46
USPC ..... 123/90.15
See application file for complete search history.

(56) References Cited

U.S. PATENT DOCUMENTS

2015/0300214 A1* 10/2015 Hemphill ..... F01L 1/34409 123/90.15

* cited by examiner

*Primary Examiner* — Jorge Leon, Jr.
(74) *Attorney, Agent, or Firm* — Simpson & Simpson, PLLC

(57) ABSTRACT

A variable camshaft phaser having a stator arranged to receive torque from an engine; a rotor arranged to be non-rotatably connected to a camshaft; a first wedge plate and a second wedge plate radially disposed between the stator and the rotor; a spinner, operatively arranged about a central hub; a paddle arranged about the spinner including an annular ring having an engagement projection extending outwardly therefrom, the engagement projection having a proximate section and a distal section; the proximate section operatively arranged to engage a twisting groove of the spinner, and the distal section operatively arranged to engage either the first or second wedge plates; wherein the spinner, paddle, central hub, and engagement projection are operatively arranged to displace the first or the second wedge plate in either an advance mode or in a retard mode.

20 Claims, 14 Drawing Sheets

VARIABLE CAMSHAFT PHASER WITH A LINEAR ACTUATOR FOR ABSOLUTE POSITIONING

FIELD

The present disclosure relates to a multi-position camshaft phaser with two one-way wedge clutches. In particular, the two one-way wedge clutches are used to advance and retard the phase of the rotor with respect to the stator.

BACKGROUND

It is known to use fluid pressure in chambers created by respective portions of a stator and a rotor for a camshaft phaser to maintain and shift a rotational position of the rotor with respect to the stator. This known technique involves complicated hydraulic systems and controls.

SUMMARY

An example embodiment comprises a variable camshaft phaser, having a stator arranged to receive torque from an engine; a rotor arranged to be non-rotatably connected to a camshaft; a first wedge plate and a second wedge plate radially disposed between the stator and the rotor; a spinner, operatively arranged about a central hub, the spinner having a twisting groove therein; a paddle arranged about the spinner comprising an annular ring having an engagement projection extending outwardly therefrom, the engagement projection having a proximate section and a distal section; the proximate section operatively arranged to engage the twisting groove, and the distal section operatively arranged to engage either the first or second wedge plates; wherein the spinner, paddle, central hub, and engagement projection are operatively arranged to displace the first or the second wedge plate in either an advance mode or in a retard mode; wherein, in the advance mode, the central hub and the spinner are displaced in a first axial direction to enable rotation of the paddle with respect to the rotor, and engage the first wedge plate in a first circumferential direction; and, wherein, in the retard mode, the central hub and the spinner are displaced in a second axial direction, opposite the first axial direction, to enable rotation of the paddle with respect to the rotor, and engage the second wedge plate in a second circumferential direction, opposite the first circumferential direction.

Another example embodiment comprises a variable camshaft phaser, having a stator arranged to receive torque from an engine; a rotor arranged to be non-rotatably connected to a camshaft, the rotor including a first and a second circumferentially arranged groove; a first wedge plate radially disposed between the stator and the rotor and arranged within the first circumferentially arranged groove; a second wedge plate radially disposed between the stator and the rotor and arranged within the second circumferentially arranged groove; a paddle comprising an annular ring having an engagement projection extending outwardly therefrom, the engagement projection having a proximate section and a distal section; the proximate section operatively arranged to engage a central hub, and the distal section operatively arranged to engage either the first or second wedge plates; wherein the paddle and engagement projection are operatively arranged to displace the first or the second wedge plate in either an advance mode or in a retard mode; wherein, in the advance mode, the paddle is displaced in a first circumferential direction to engage the first wedge plate in the first circumferential direction; and, wherein, in the retard mode, the paddle is displaced in a second circumferential direction, opposite the first axial direction, to engage the second wedge plate in the second circumferential direction, opposite the first circumferential direction.

Yet another example embodiment comprises a variable camshaft phaser having a rotor arranged to be non-rotatably connected to a camshaft; a spinner, operatively arranged about a central hub, the spinner having a twisting groove therein; a paddle arranged about the spinner comprising an annular ring having an engagement projection extending outwardly therefrom, the engagement projection having a proximate section and a distal section; the proximate section operatively arranged to engage the twisting groove, and the distal section operatively arranged to extend radially outward within a channel.

These and other objects, features and advantages of the example embodiments will be readily appreciated by those having ordinary skill in the art upon a reading of the following detailed description of the embodiments in view of the drawings and appended claims.

BRIEF DESCRIPTION OF THE DRAWINGS

Various embodiments are disclosed, by way of example only, with reference to the accompanying schematic drawings in which corresponding reference symbols indicate corresponding parts, in which.

DETAILED DESCRIPTION OF EMBODIMENTS

At the outset, it should be appreciated that like drawing numbers on different drawing views identify identical, or functionally similar, structural elements. It is to be understood that the invention as claimed is not limited to the disclosed aspects.

Furthermore, it is understood that this disclosure is not limited to the particular methodology, materials and modifications described and as such may, of course, vary. It is also understood that the terminology used herein is for the purpose of describing particular aspects only, and is not intended to limit the scope of the claims.

Unless defined otherwise, all technical and scientific terms used herein have the same meaning as commonly understood to one of ordinary skill in the art to which this disclosure pertains. It should be understood that any methods, devices or materials similar or equivalent to those described herein can be used in the practice or testing of the example embodiments. The assembly of the present disclosure could be driven by hydraulics, electronics, and/or pneumatics.

It should be appreciated that the term "substantially" is synonymous with terms such as "nearly", "very nearly", "about", "approximately", "around", "bordering on", "close to", "essentially", "in the neighborhood of", "in the vicinity of", etc., and such terms may be used interchangeably as appearing in the specification and claims. It should be appreciated that the term "proximate" is synonymous with terms such as "nearby", "close", "adjacent", "neighboring", "immediate", "adjoining", etc., and such terms may be used interchangeably as appearing in the specification and claims.

By "non-rotatably connected" elements, we mean that: the elements are connected so that whenever one of the elements rotate, all the elements rotate; and relative rotation between the elements is not possible. Radial and/or axial movement of non-rotatably connected elements with respect to each other is possible, but not required.

Figure 1:
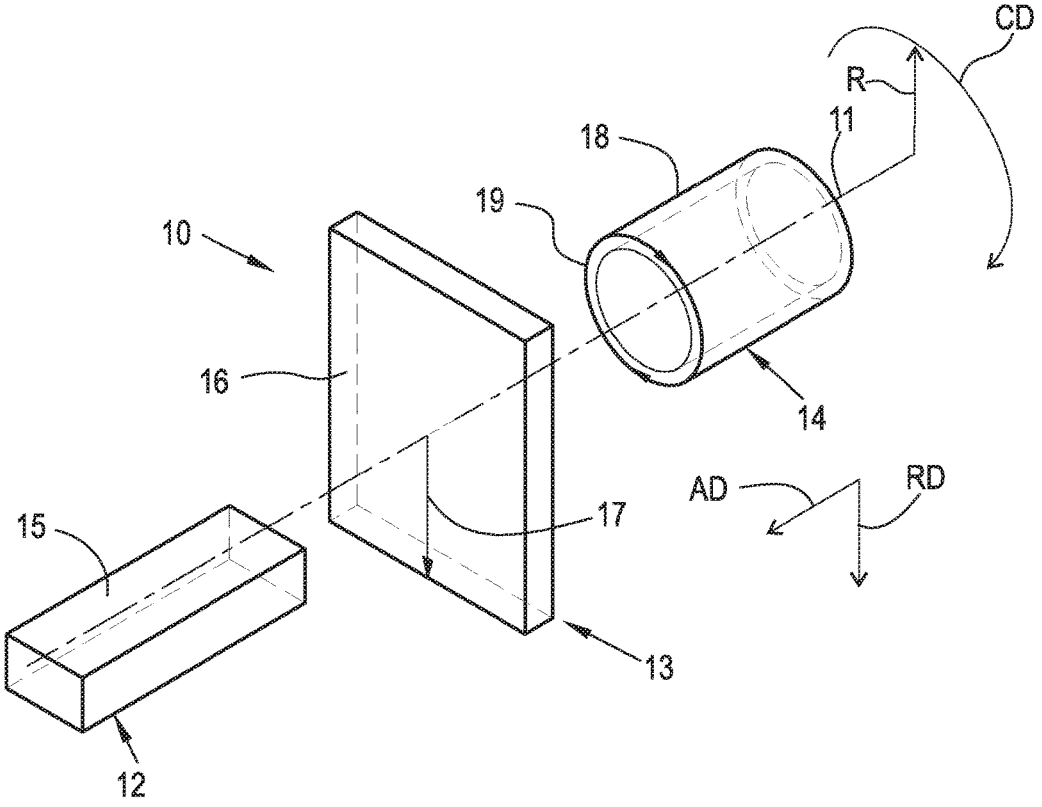
FIG. 1 is a perspective view of a cylindrical coordinate system demonstrating spatial terminology used in the present application.

Adverting now to the figures, FIG. 1 is a perspective view of cylindrical coordinate system 10 demonstrating spatial terminology used in the present application. The present application is at least partially described within the context of a cylindrical coordinate system. System 10 includes longitudinal axis 11, used as the reference for the directional and spatial terms that follow. Axial direction AD is parallel to axis 11. Radial direction RD is orthogonal to axis 11. Circumferential direction CD is defined by an endpoint of radius R (orthogonal to axis 11) rotated about axis 11.

To clarify the spatial terminology, objects 12, 13, and 14 are used. An axial surface, such as surface 15 of object 12, is formed by a plane co-planar with axis 11. Axis 11 passes through planar surface 15; however any planar surface co-planar with axis 11 is an axial surface. A radial surface, such as surface 16 of object 13, is formed by a plane orthogonal to axis 11 and co-planar with a radius, for example, radius 17. Radius 17 passes through planar surface 16; however any planar surface co-planar with radius 17 is a radial surface. Surface 18 of object 14 forms a circumferential, or cylindrical, surface. For example, circumference 19 is passes through surface 18. As a further example, axial movement is parallel to axis 11, radial movement is orthogonal to axis 11, and circumferential movement is parallel to circumference 19. Rotational movement is with respect to axis 11. The adverbs "axially," "radially," and "circumferentially" refer to orientations parallel to axis 11, radius 17, and circumference 19, respectively. For example, an axially disposed surface or edge extends in direction AD, a radially disposed surface or edge extends in direction R, and a circumferentially disposed surface or edge extends in direction CD.

Figure 2:
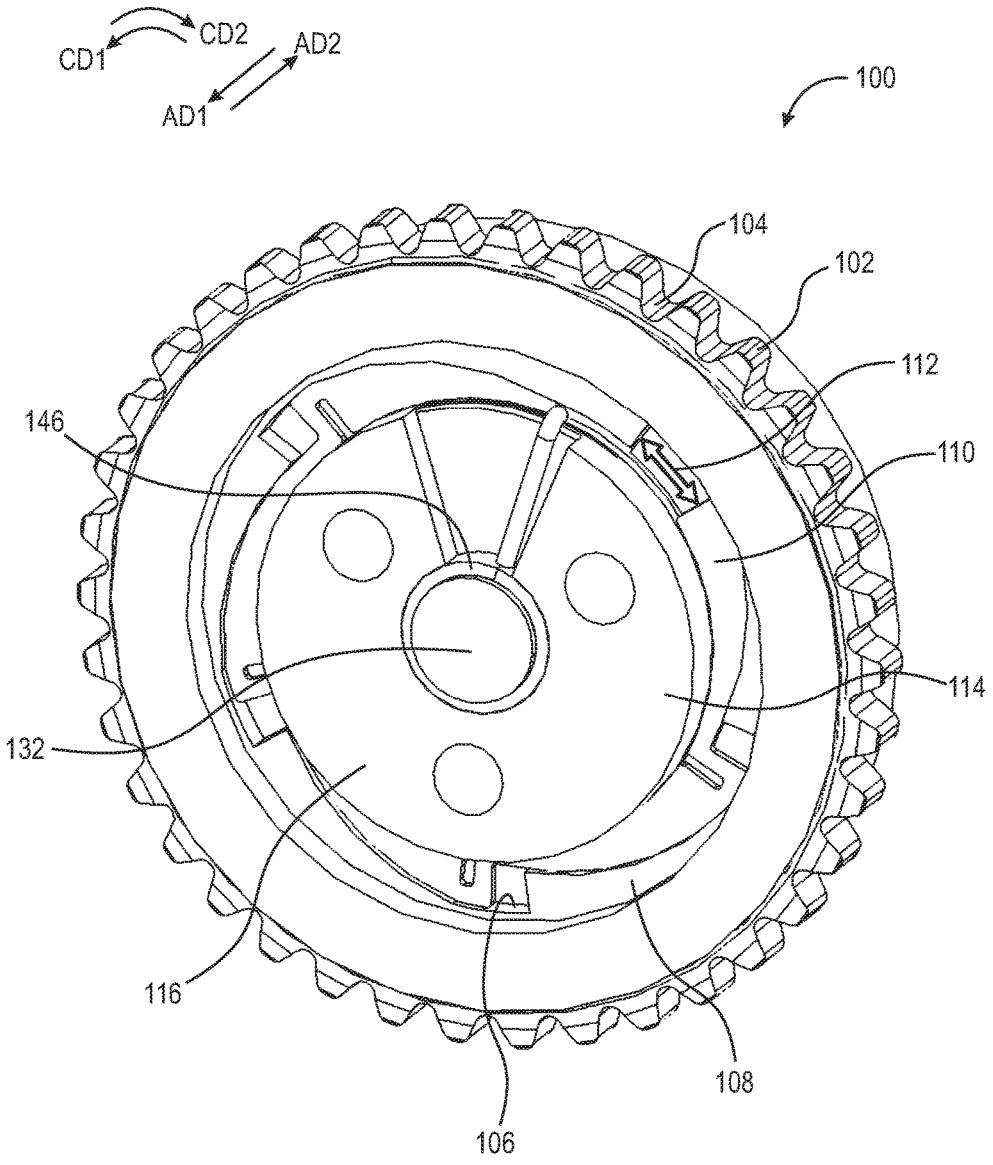
FIG. 2 is a perspective view of the back face of the camshaft phaser 100.
Figure 3:
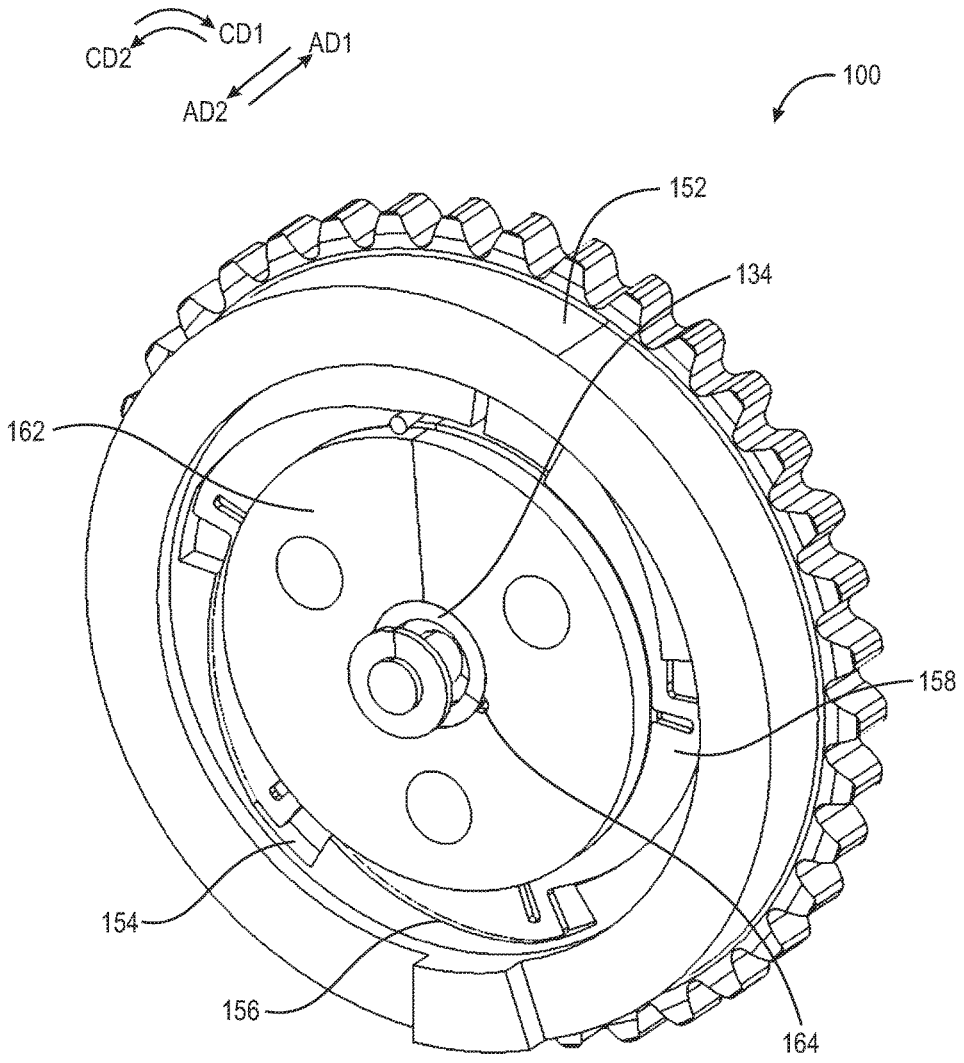
FIG. 3 is a perspective view of the front face of the camshaft phaser 100.
Figure 4:
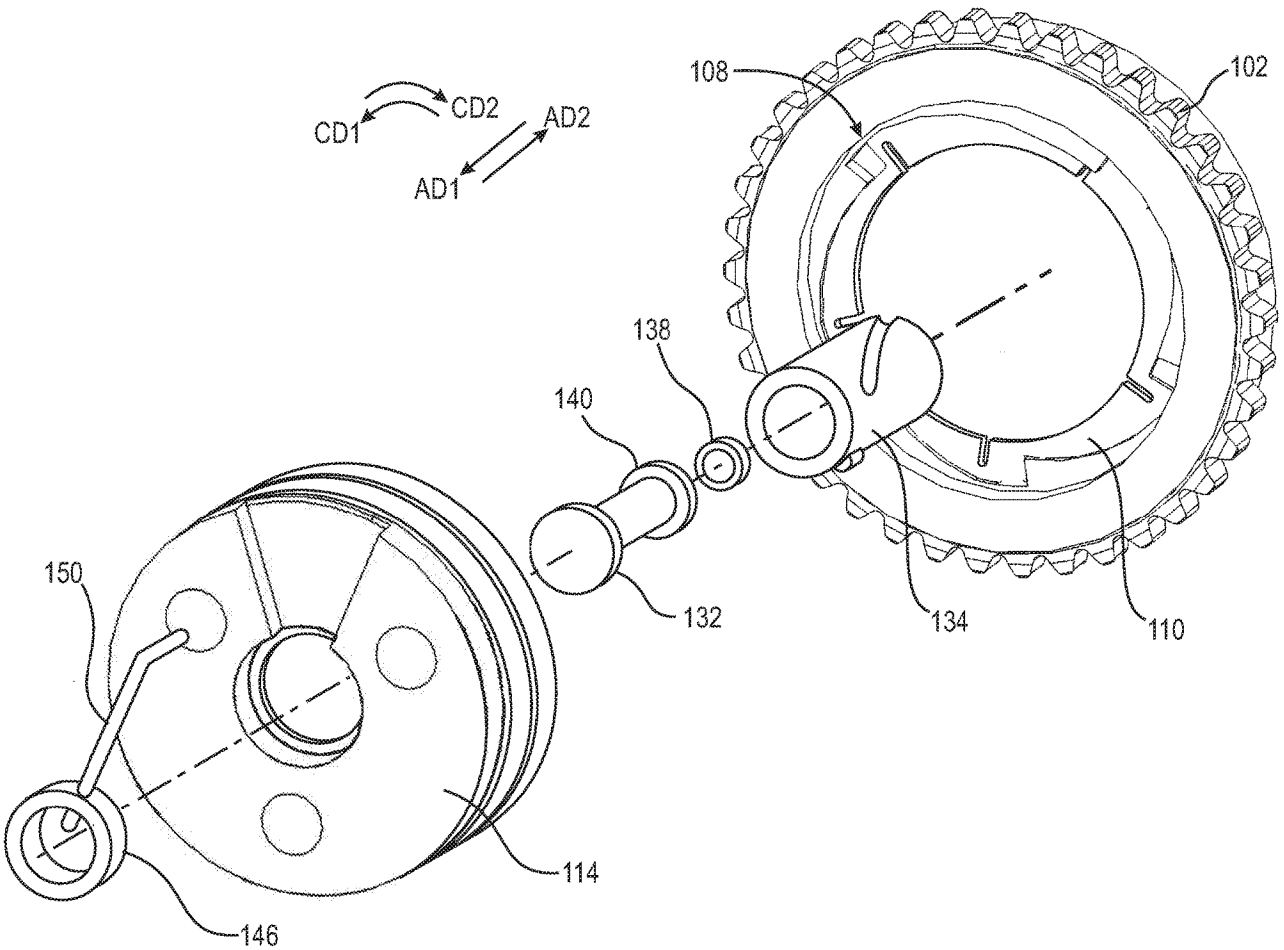
FIG. 4 is an exploded view of the back face of the camshaft phaser 100.
Figure 5A:
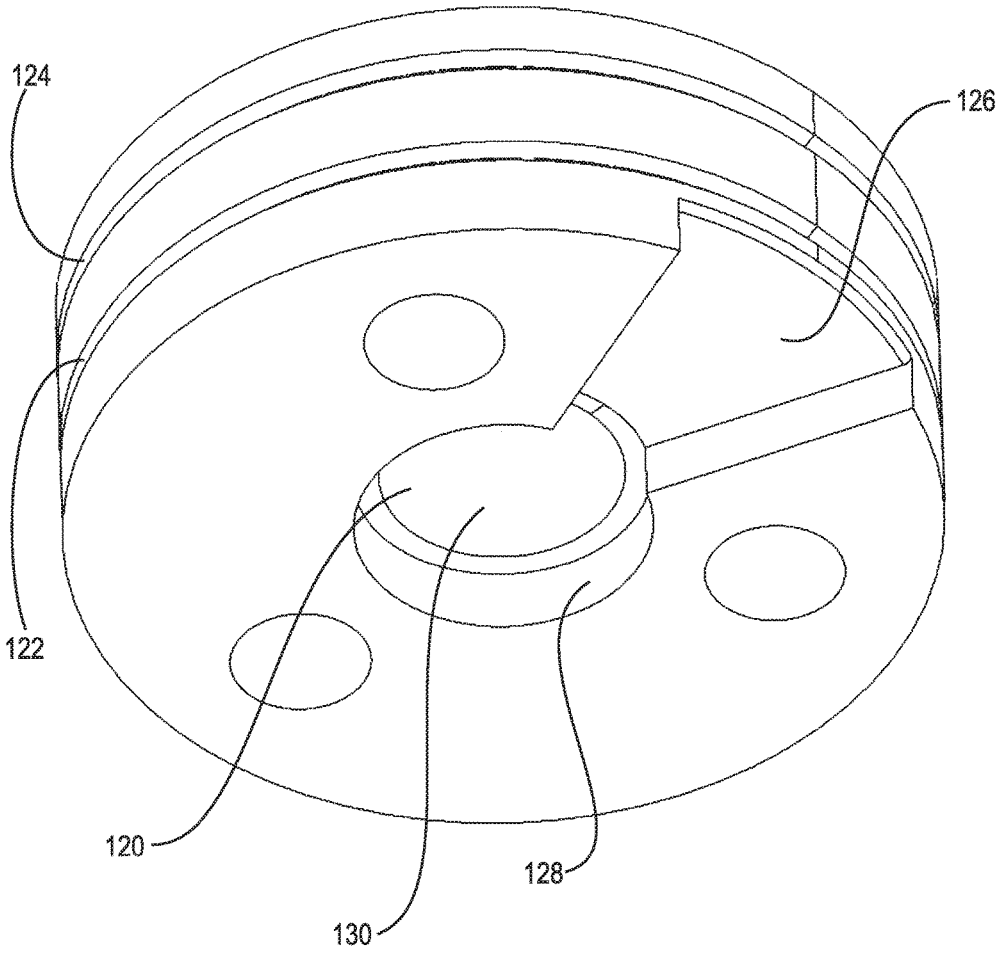
FIG. 5*a* is a perspective view of the back face of the rotor.
Figure 5B:
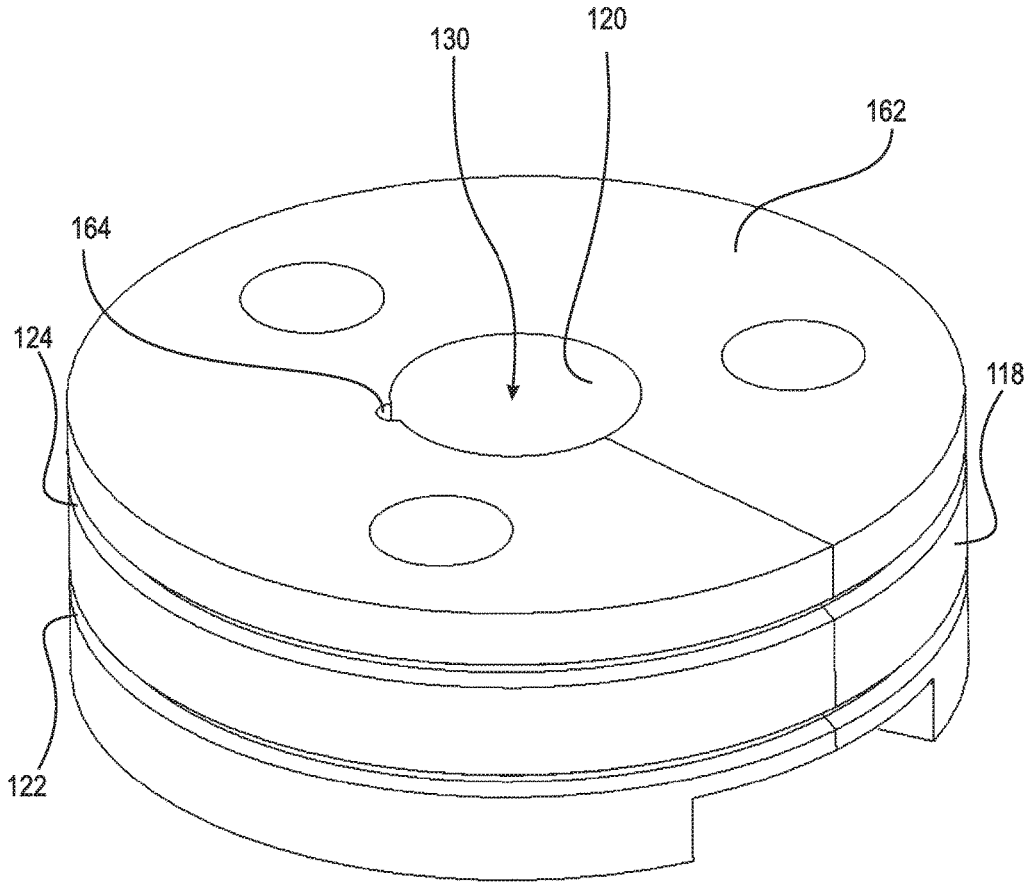
FIG. 5*b* is a perspective view of the front face of the rotor.
Figure 6A:
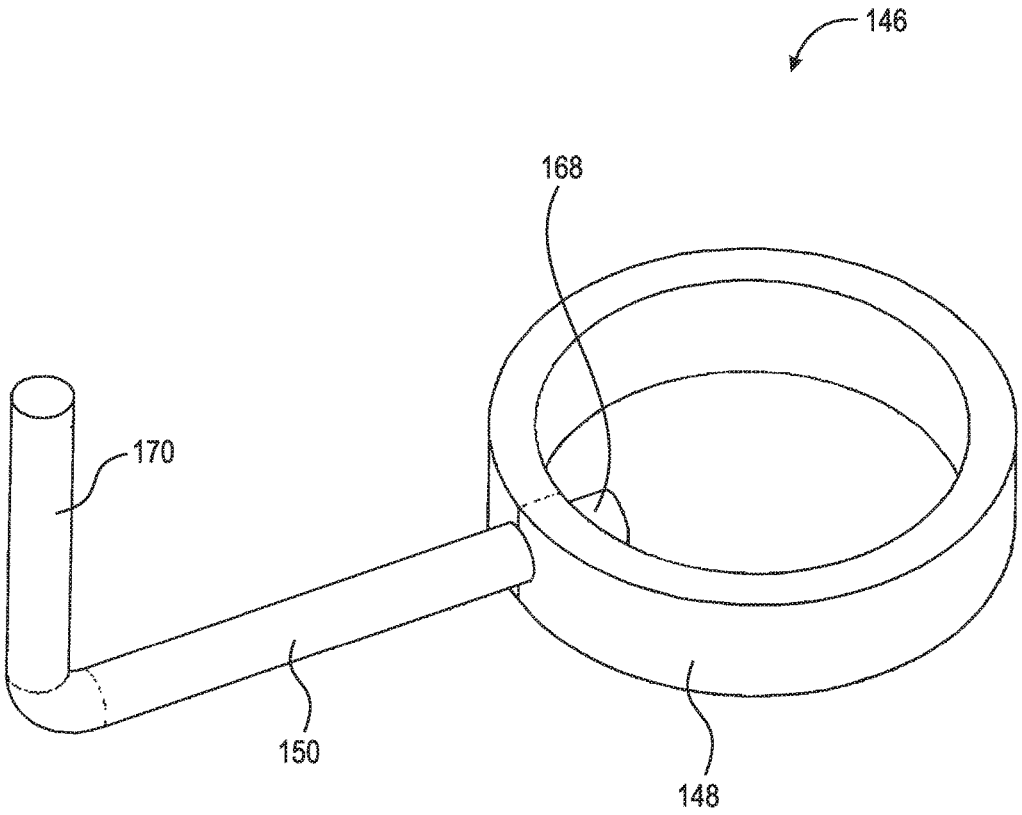
FIG. 6*a* is a perspective view of the paddle.
Figure 6B:
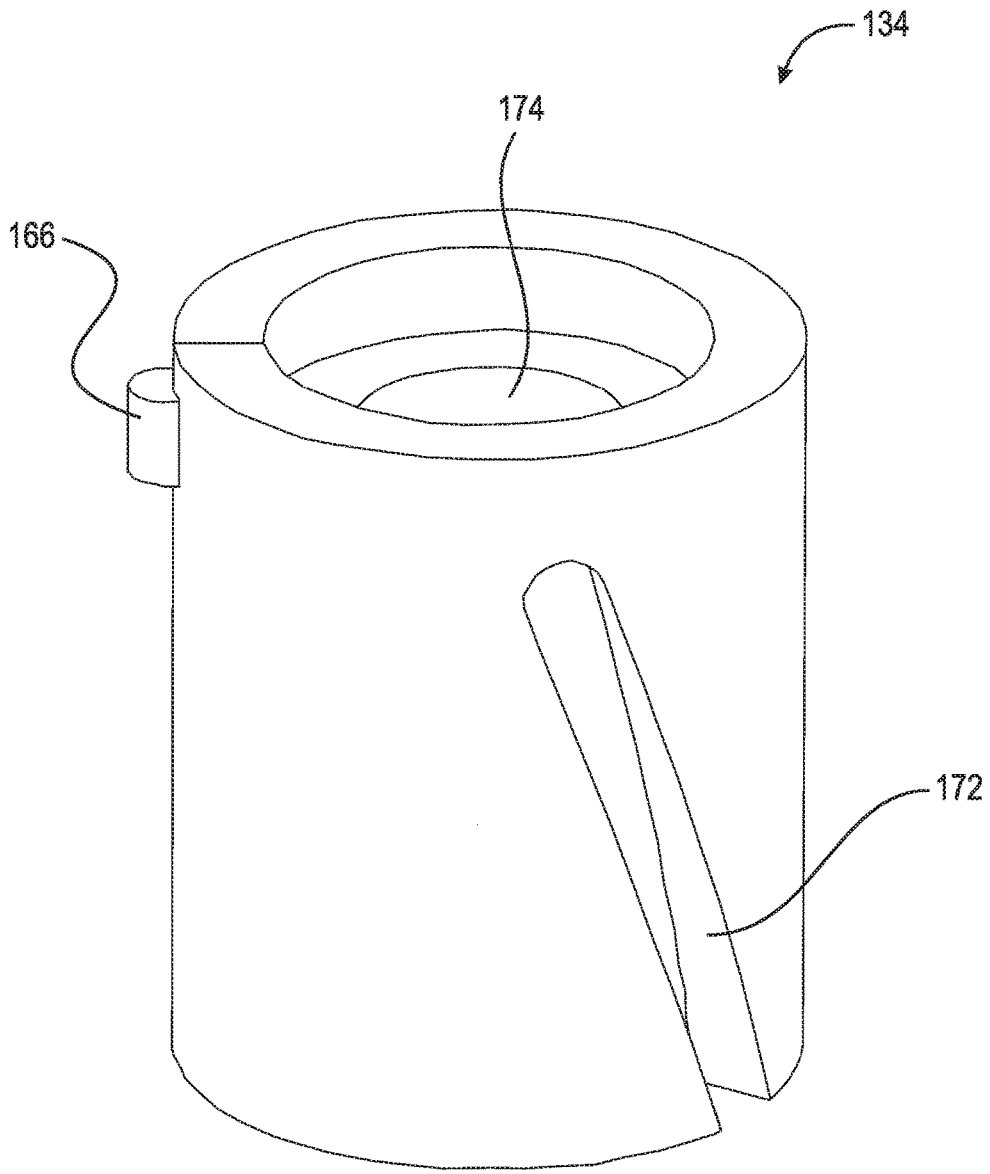
FIG. 6*b* is a perspective view of the spinner.
Figure 6C:
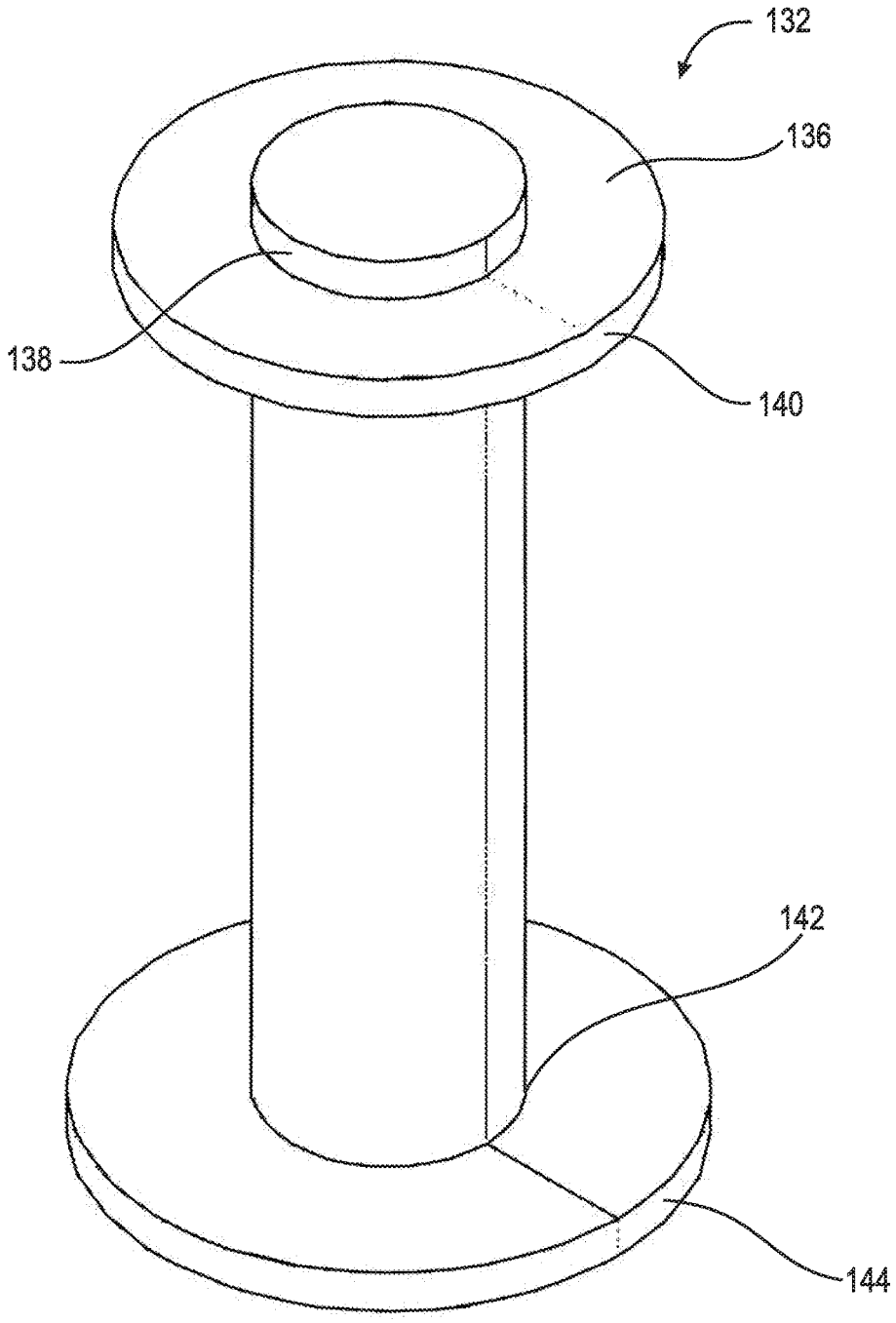
FIG. 6*c* is a perspective view of the central hub.
Figure 7:
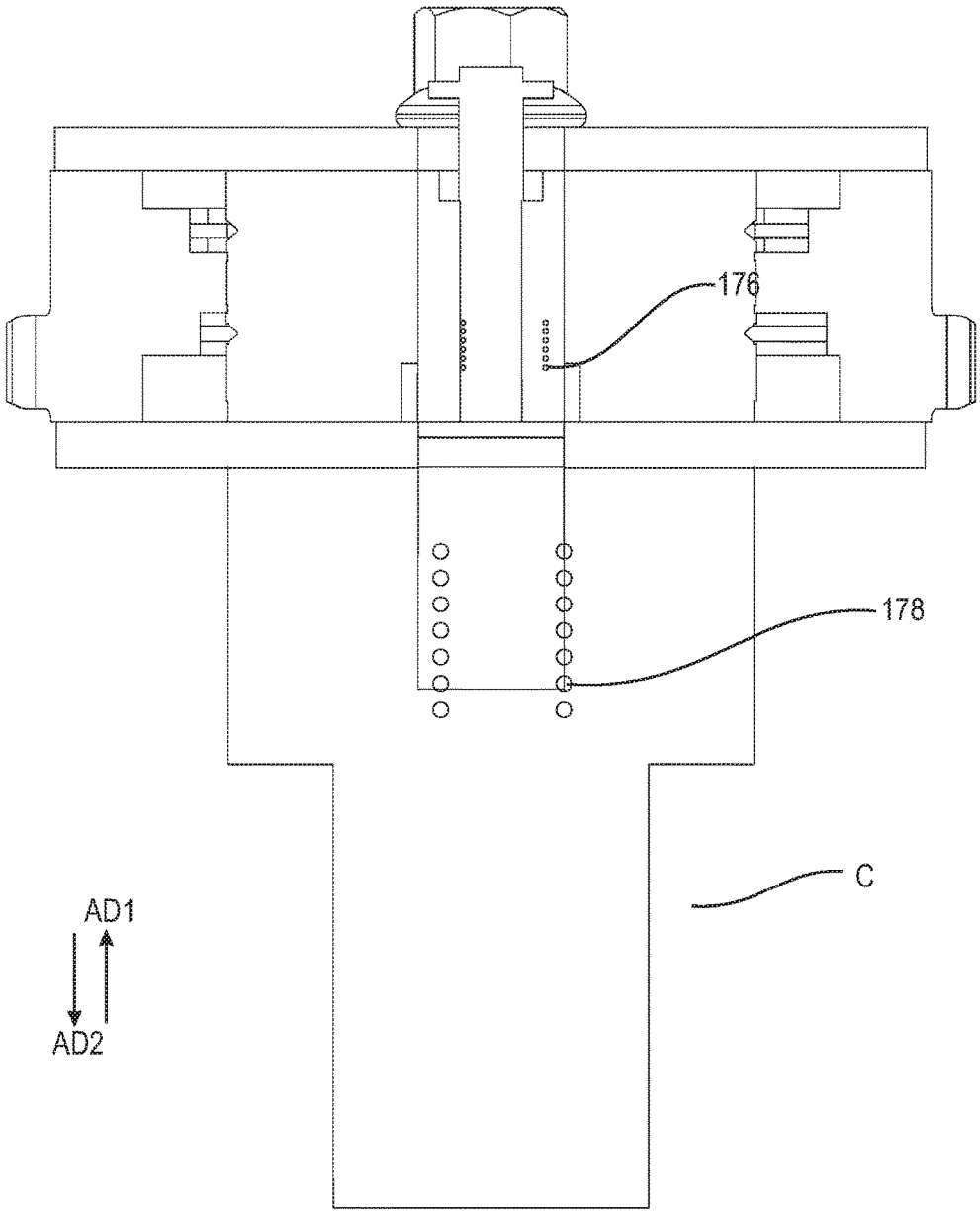
FIG. 7 is a top-down cross-sectional view of the camshaft phaser 100.
Figure 8A:
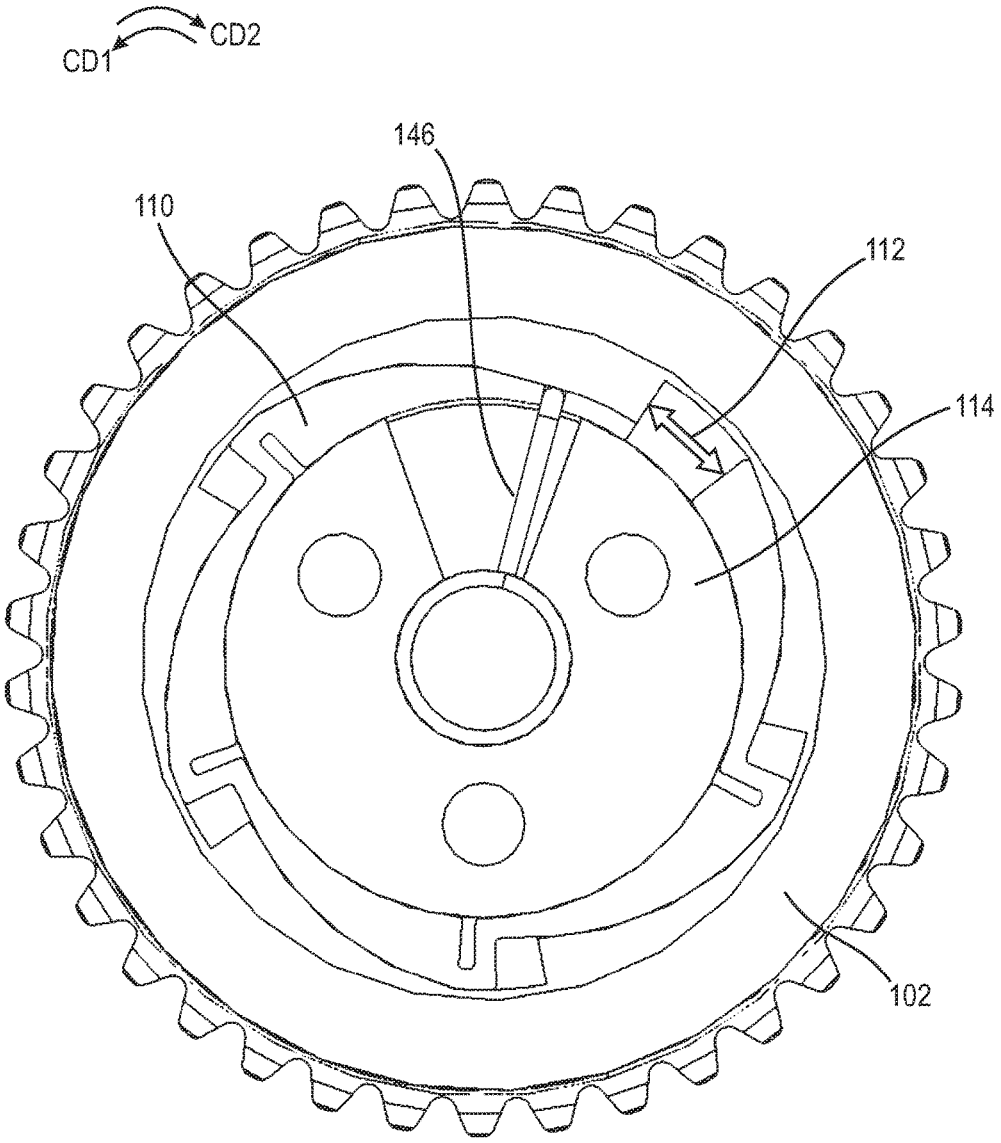
FIG. 8*a* is a side view of the back face of the camshaft phaser 100 in a retard mode.
Figure 8B:
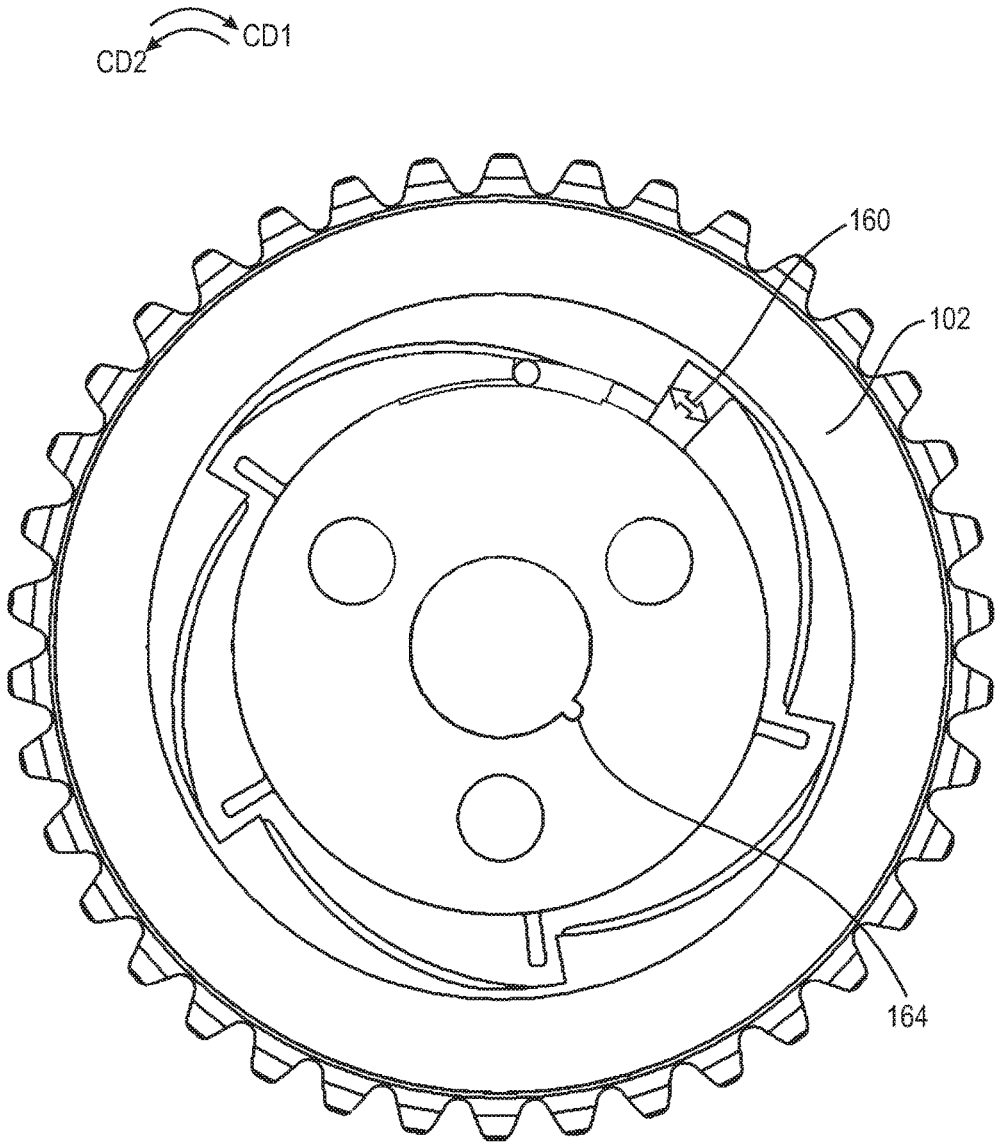
FIG. 8*b* is a side view of the front face of the camshaft phaser 100 in an advance mode where the wedge plate is disengaged.
Figure 8C:
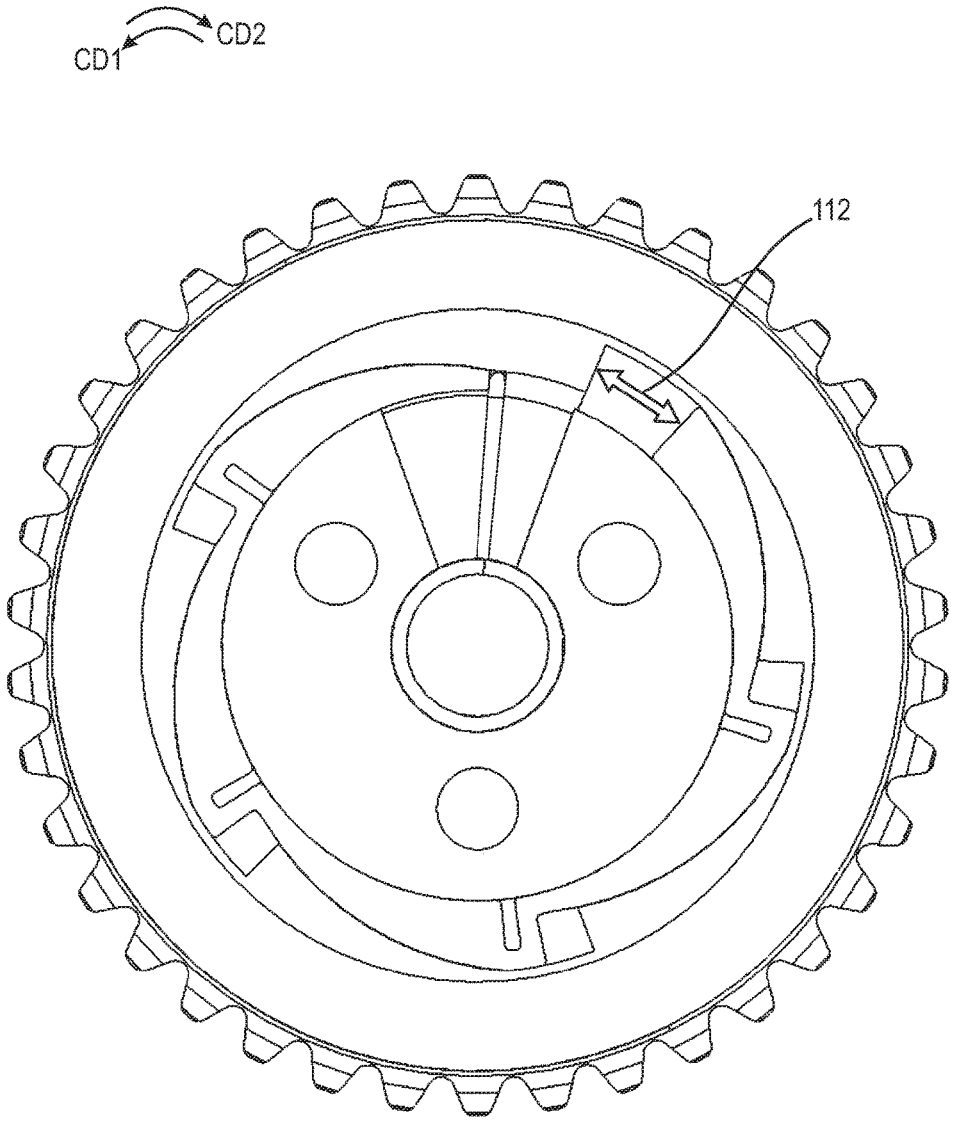
FIG. 8*c* is a side view of the back face of the camshaft phaser 100 in an advance mode where the wedge plate has reengaged; and, FIG. 9 is a perspective view of the front face of the camshaft phaser 100 shown with a cover plate and fastening bolts.
Figure 9:
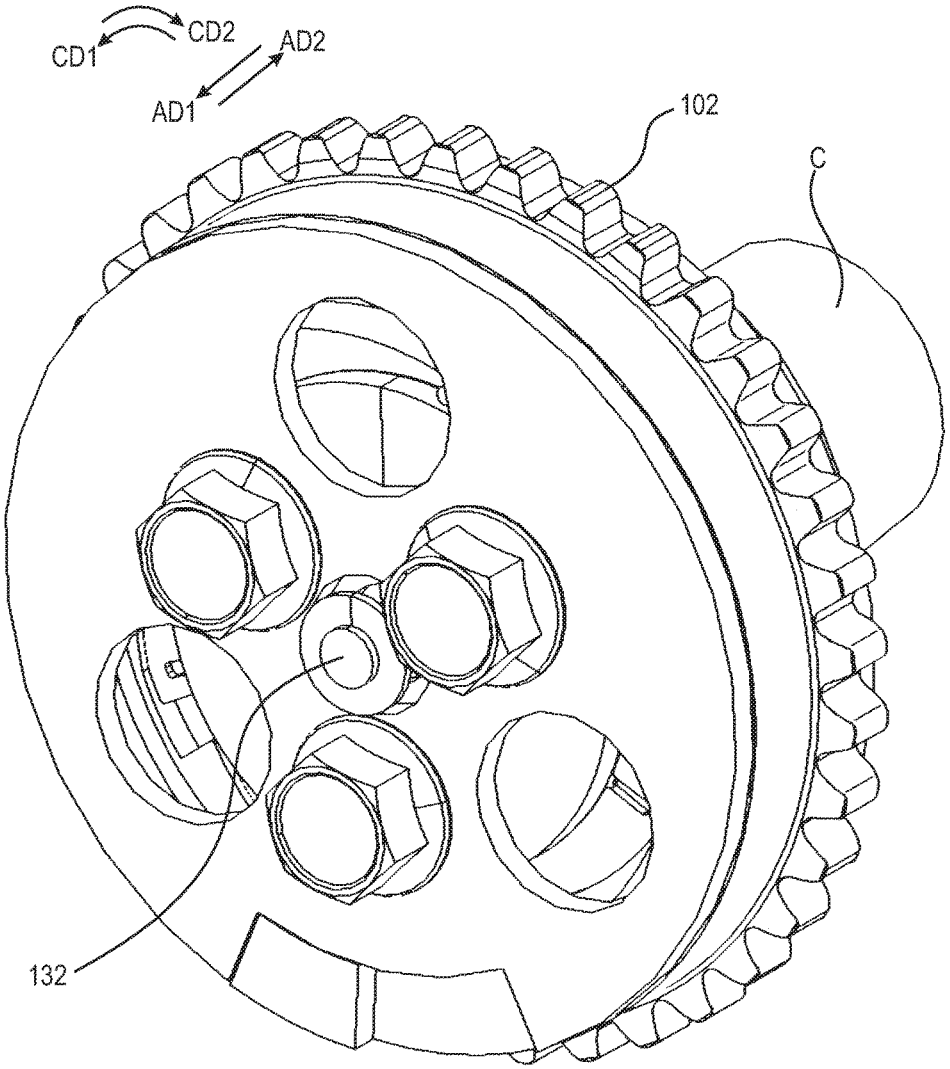

FIG. 2 is a perspective view of the back face of the camshaft phaser 100 in a retard mode. FIG. 3 is a perspective view of the front face of camshaft phaser 100. FIG. 4 is an exploded perspective view of the back face of camshaft phaser 100. FIG. 5*a* is a perspective view of back face 116 of rotor 114. FIG. 5*b* is a perspective view of front face 162 of rotor 114. FIG. 6*a* is a perspective view of paddle 146. FIG. 6*b* is a perspective view of spinner 134. FIG. 6*c* is a perspective view of central hub 132 having first distal 136 end, snap ring 138 washer 140, and second distal end 142 having a fixed disk 144. FIG. 7 is a top-down cross-sectional view of camshaft phaser 100. FIG. 8*a* shows a side view of the back face of camshaft phaser 100 in a locked fully retard mode. FIG. 8*b* shows a side view of the front face of the camshaft phaser 100 in an unlocked neutral mode. FIG. 8*c* shows a side view of the back face of camshaft phaser 100 in a locked neutral mode. FIG. 9 is a perspective view of the back face of the camshaft phaser 100 shown with a cover plate and fastening bolts.

The following description should be read in view of FIGS. 2-9. Camshaft phaser 100 contains a stator 102 having a first radially outwardly facing surface 104 and a first radially inwardly facing surface 106. The first radially inwardly facing surface 106 has a first plurality of ramps 108, operatively arranged to receive a first wedge plate 110. In a preferred embodiment, stator 102 further contains a circumferentially disposed first wedge plate spring 112 arranged between first plurality of ramps 108 and first wedge plate 110.

Camshaft phaser 100 further contains a rotor 114 which is nonrotatably connected to a camshaft C having a back face 116, a first radially outwardly facing surface 118, and a first radially inwardly facing surface 120. First radially outwardly facing surface 118 has a first circumferential groove 122 and a second circumferential groove 124. First wedge plate 110 is arranged within first circumferentially arrange groove 122 within rotor 114. Back face 116 of rotor 114 further contains channel 126 and a coaxially arranged groove 128. Back face 116 has a through bore 130. Within through bore 130, there is a central hub 132, and a spinner 134. The central hub 132 has a first distal 136 end including a snap ring 138 and a washer 140, and a second distal end 142 including a fixed disk 144. Spinner 134 is arranged coaxially about central hub 132.

Camshaft phaser 100 also contains a paddle 146 arranged about spinner 134 and central hub 132. Paddle 146 has an annular ring 148, operatively arrange about spinner 134 and within coaxially arranged groove 128; and an engagement projection 150 extending radially outwardly therefrom and within channel 126. In a preferred embodiment, engagement projection 150 is a steel wire that has been bent at a 90 degree angle such that the bent portion can contact first wedge plate 110. The circumferential width of channel 126 limits the possible circumferential angular motion of engagement projection 150.

Stator 102 further contains a second radially outwardly facing surface 152 and a second radially inwardly facing surface 154. Second radially inwardly facing surface 154 has a second plurality of ramps 156, operatively arranged to receive a second wedge plate 158. In a preferred embodiment, stator 102 further contains a circumferentially disposed second wedge plate spring 160 arranged between second plurality of ramps 156 and second wedge plate 158.

Rotor 114 further contains a front face 162, wherein said first radially inwardly facing surface 120 further contains an axial groove 164 arranged to receive an anti-rotation projection 166 of spinner 134.

The various figures show the arrangement of stator 102, with first plurality of ramps 108, arranged to receive first wedge plate 110; rotor 114 having a through bore 130, a channel 126 and coaxially arranged groove 128 operatively arranged to receive engagement projection 150 and annular ring 148 of paddle 146 respectively.

The various figures shows first circumferential groove 122 and second circumferential groove 124 of first radially outwardly facing surface 118 of rotor 114 and the coaxially arranged groove 128 and channel 126 operatively arranged to receive annular ring 148 and engagement projection 150 respectively.

The figures also show the axial groove 164 arranged to receive anti-rotation projection 166 of spinner 134.

The figures also show engagement projection 150 and annular ring 148. In addition, engagement projection 150 further comprises a proximate section 168 and a distal section 170. Proximate section 168 extends within annular ring 148. Distal section 170 is shown in a preferred embodiment, bent at a 90 degree angle, such that it can contact, and subsequently disengage, first wedge plate 110.

The figures also show anti-rotation projection 166 and twisting groove 172. Anti-rotation projection 166 is radially disposed on the outwardly facing surface of spinner 134 and is arranged to slidingly engage with the axial groove 164. Twisting groove 172 is operatively arranged to receive proximate section 168 of engagement projection 150 that extends within annular ring 148 of paddle 146. Spinner 134 also contains a through bore 174 arranged to receive central hub 132.

Central hub 132 is arranged within through bore 130 of rotor 114. During assembly, central hub 132 is placed within through bore 174 of spinner 134, and spinner 134 and central hub 132 are placed within through bore 130 of rotor 114.

Furthermore, the figures show the positioning of upper spring 176 and lower spring 178. Upper spring 176 is axially disposed between spinner 134 and central hub 132. Lower spring 178 is axially disposed between central hub 132 and camshaft C. These springs bias the central hub away from camshaft C.

Central hub 132 can be displaced in a first axial direction AD1. The central hub can be displaced by a variety of mechanisms known in the art, such as a linear actuator. When central hub 132 is displaced in first axial direction AD1, upper spring 176 and lower spring 178 are compressed, and resist the imparted axial motion. Spinner 134, which is disposed about central hub 132, is displaced along with central hub 132. As spinner 134 and central hub 132 are displaced in first axial direction AD1, anti-rotation projection 166 of spinner 134 slides along axial groove 164 of first inwardly facing surface 120. As spinner 134 is displaced in first axial direction AD1, the proximate section 168 of engagement projection 150 of paddle 146, which rides within twisting groove 172, is forced in first circumferential direction CD1. In the absence of linear force in first axial direction AD1, upper spring 176 and lower spring 178 force central hub 132 and spinner 134 in a second axial direction AD2. Thereby causing proximate section 168 of engagement projection 150 of paddle 146 to ride along twisting groove 172 in the opposite direction axial direction AD2, forcing the paddle in a second circumferential direction CD2.

Paddle 146 can therefore be displaced in first circumferential direction CD1 or second circumferential direction CD2. Distal section 170 of engagement projection 150 of paddle 146 extends through stator 102 allowing for contact with either first wedge plate 110 or second wedge plate 158.

For an advance mode, the central hub 132 and spinner 134 are displaced in first axial direction AD1. This motion results in paddle 146 becoming displaced in first circumferential CD1. When paddle 146 is displaced in circumferential direction CD1, paddle 146 displaces, and subsequently disengages, first wedge plate 110 from first plurality of ramps 108 allowing for rotation of stator 102 free from frictional contact with wedge plate 110. Stator 102, which is constantly rotating proportional to the rotation of the engine in first circumferential direction CD1, continues to rotation in first circumferential direction CD1 until it reengages with wedge plate 110 and becomes locked.

For a retard mode, the central hub and spinner no longer receive linear force displacing them in first axial direction AD1. The absence of linear pressure results in upper spring 176 and lower spring 178 applying pressure in second axial direction AD2. This displaces paddle 146 in a second circumferential direction CD2. Distal section 170 of engagement projection 150 of paddle 146 displaces, and subsequently disengages, second wedge plate 158 from second plurality of ramps 156 allowing for rotation of stator 102 free from frictional contact with wedge plate 158. Stator 102, which is constantly rotating proportional to the rotation of the engine in first circumferential direction CD1, continues to rotation in first circumferential direction CD1 until it reengages with wedge plate 158 and becomes locked.

Therefore, depending on whether linear force is applied to central hub 132 in first axial direction AD1, first wedge plate 110 or second wedge plate 158 will become disengaged, either advancing or retarding the camshaft timing respectively. It is to be understood that since linear motion imparted on central hub 132 can be precise, it is possible to advance or retard the timing of the camshaft with equal precision. For example, proportional linear motion imparted on the central hub 132 in first axial direction AD1 could result in an angular rotation as precise as 1 degree in first circumferential direction CD1, resulting in an equally precise advancement of overall camshaft timing.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A variable camshaft phaser, comprising:

a stator arranged to receive torque from an engine;

a rotor arranged to be non-rotatably connected to a camshaft;

a first wedge plate and a second wedge plate radially disposed between said stator and said rotor;

a spinner, operatively arranged about a central hub, said spinner having a twisting groove therein;

a paddle arranged about said spinner comprising an annular ring having an engagement projection extending outwardly therefrom, said engagement projection having a proximate section and a distal section; said proximate section operatively arranged to engage said twisting groove, and said distal section operatively arranged to engage either said first or second wedge plates;

wherein said spinner, paddle, central hub, and engagement projection are operatively arranged to displace said first or said second wedge plate in either an advance mode or in a retard mode;

wherein, in said advance mode, the central hub and the spinner are displaced in a first axial direction to enable rotation of the paddle with respect to the rotor, and engage said first wedge plate in a first circumferential direction; and, wherein, in said retard mode, said central hub and said spinner are displaced in a second axial direction, opposite said first axial direction, to enable rotation of said paddle with respect to said rotor, and engage said second wedge plate in a second circumferential direction, opposite said first circumferential direction.

2. The variable camshaft phaser of claim 1, wherein said rotor further comprises:

a through-bore arranged on said rotor;

a first radially outwardly facing surface;

a first radially inwardly facing surface;

a front face in said first axial direction; and, a back face in said second axial direction having a channel operatively arranged to receive the distal section of said engagement projection and a coaxially arranged groove arranged to operatively receive the annular ring of said paddle.

3. The variable camshaft phaser of claim 2, wherein said radially inwardly facing surface of said rotor has an axial groove arranged to receive an anti-rotation projection of said spinner.

4. The variable camshaft phaser of claim 1, wherein said stator further comprises:

a first radially outwardly facing surface;

a second radially outwardly facing surface;

a first radially inwardly facing surface wherein said first radially inwardly facing surface has a first plurality of ramps arranged to frictionally engage said first wedge plate; and, a second radially inwardly facing surface wherein said second radially inwardly facing surface has a second plurality of ramps arranged to frictionally engage said second wedge plate.

5. The variable camshaft phaser of claim 4, wherein said stator further comprises a first wedge plate spring fixedly secured between said first wedge plate and said first plurality of ramps.

6. The variable camshaft phaser of claim 5, wherein said stator further comprises a second wedge plate spring fixedly secured between said second wedge plate and said second plurality of ramps.

7. The variable camshaft phaser of claim 1, wherein said central hub further comprises a first distal end including a snap ring and a washer, and a second distal end including a fixed disk.

8. A variable camshaft phaser, comprising:

a stator arranged to receive torque from an engine;

a rotor arranged to be non-rotatably connected to a camshaft, said rotor including a first and a second circumferentially arranged groove;

a first wedge plate radially disposed between said stator and said rotor and arranged within said first circumferentially arranged groove;

a second wedge plate radially disposed between said stator and said rotor and arranged within said second circumferentially arranged groove;

a paddle comprising an annular ring having an engagement projection extending outwardly therefrom, said engagement projection having a proximate section and a distal section; said proximate section operatively arranged to engage a central hub, and said distal section operatively arranged to engage either said first or second wedge plates;

wherein said paddle and engagement projection are operatively arranged to displace said first or said second wedge plate in either an advance mode or in a retard mode;

wherein, in said advance mode, said paddle is displaced in a first circumferential direction to engage said first wedge plate in said first circumferential direction; and, wherein, in said retard mode, said paddle is displaced in a second circumferential direction, opposite said first circumferential direction, to engage said second wedge plate in said second circumferential direction.

9. The variable camshaft phaser of claim 8, wherein said rotor further comprises:

a through-bore arranged on said rotor;

a first radially outwardly facing surface;

a first radially inwardly facing surface;

a front face in a first axial direction; and, a back face in a second axial direction having a channel operatively arranged to receive said distal section of said engagement projection and a coaxially arranged groove arranged to operatively receive said annular ring of said paddle.

10. The variable camshaft phaser of claim 9, wherein said radially inwardly facing surface of said rotor has an axial groove arranged to receive an anti-rotation projection of said spinner.

11. The variable camshaft phaser of claim 8, further comprising a spinner arranged about said central hub, wherein said spinner has a twisting groove therein, operatively arranged to receive said proximate section of said engagement projection.

12. The variable camshaft phaser of claim 11, wherein said stator further comprises an upper spring and a lower spring, wherein said upper spring is axially disposed between said central hub and said spinner and said lower spring is axially disposed between said central hub and said camshaft.

13. The variable camshaft phaser of claim 8, wherein said stator further comprises:

a first radially outwardly facing surface;

a second radially outwardly facing surface;

a first radially inwardly facing surface wherein said first radially inwardly facing surface has a first plurality of ramps arranged to frictionally engage said first wedge plate; and, a second radially inwardly facing surface wherein said second radially inwardly facing surface has a second plurality of ramps arranged to frictionally engage said second wedge plate.

14. The variable camshaft phaser of claim 13, wherein said stator further comprises a first wedge plate spring fixedly secured between said first wedge plate and said first plurality of ramps.

15. The variable camshaft phaser of claim 14, wherein said stator further comprises a second wedge plate spring fixedly secured between said second wedge plate and said second plurality of ramps.

16. The variable camshaft phaser of claim 8, wherein said central hub further comprises a first distal end including a snap ring and a washer, and a second distal end including a fixed disk.

17. A variable camshaft phaser comprising:

a rotor arranged to be non-rotatably connected to a camshaft;

a spinner, operatively arranged about a central hub, said spinner having a twisting groove therein;

a paddle arranged about said spinner comprising an annular ring having an engagement projection extending outwardly therefrom, said engagement projection having a proximate section and a distal section; said proximate section operatively arranged to engage said twisting groove, and said distal section operatively arranged to extend radially outward within a channel.

18. The variable camshaft phaser of claim 17, wherein said rotor further comprises: a first circumferentially arranged groove and a second circumferentially arranged groove, wherein said first circumferentially arranged groove is operatively arranged to receive a first wedge plate, and said second circumferentially arranged groove is operatively arranged to receive a second wedge plate.

19. The variable camshaft phaser of claim 17, further comprising:

a stator having a first plurality of ramps and a second plurality of ramps, wherein said first plurality of ramps is arranged to receive a first wedge plate, and said second plurality of ramps is arranged to receive a second wedge plate;

a first wedge plate spring fixedly secured between said first wedge plate and said first plurality of ramps; and, a second wedge plate spring fixedly secured between said second wedge plate and said second plurality of ramps.

20. The variable camshaft phaser of claim 17, further comprising an upper spring and a lower spring wherein said upper spring is arranged axially between said central hub and said spinner, and said lower spring is arranged axially between said central hub and said camshaft.

* * * * *